US005481093A

United States Patent [19]

Rogerson

[11] Patent Number: 5,481,093

[45] Date of Patent: Jan. 2, 1996

[54] GOLF ROUND TIMING DEVICE

[75] Inventor: Zebulon W. Rogerson, Vienna, Va.

[73] Assignee: Ajay A. Jagtiani, Centreville, Va.; a part interest

[21] Appl. No.: 14,513

[22] Filed: Feb. 8, 1993

[51] Int. Cl.[6] ..... G06C 27/00; G06C 3/00

[52] U.S. Cl. ..... 235/78 R; 235/88 R

[58] Field of Search ..... 235/77, 78 R, 235/78 A, 78 F, 78 G, 78 M, 78 N, 78 RC, 83, 88 R, 88 F, 88 G, 88 M, 88 N, 88 RC

[56] References Cited

U.S. PATENT DOCUMENTS

| | | | |
|---|---|---|---|
| 1,076,680 | 10/1913 | Leonard | 235/88 R |
| 1,171,753 | 2/1916 | Serrell | 235/88 R |
| 1,277,723 | 9/1918 | Hill | 235/65 |
| 1,280,591 | 1/1918 | Tuttle | 235/88 R |
| 1,414,855 | 5/1922 | Bishop | 235/84 |
| 1,942,754 | 1/1934 | Heyssler | 235/88 R |
| 2,076,242 | 4/1937 | Marquis | 235/88 R |
| 2,098,622 | 11/1937 | Gronvold | 235/88 R |
| 2,485,191 | 10/1949 | Culver | 235/83 |
| 2,806,650 | 9/1957 | Mead | 235/88 G |
| 3,044,698 | 7/1962 | Maluf | 235/83 |
| 3,278,118 | 10/1966 | Klein, Jr. | 235/88 R |
| 3,363,836 | 6/1966 | Lee | 235/78 R |
| 3,627,200 | 12/1971 | Sadler | 235/88 G |
| 3,648,025 | 3/1972 | Adams | 235/83 |
| 3,744,714 | 7/1973 | Banner | 235/88 G |
| 3,946,207 | 3/1976 | Williams | 235/88 M |
| 4,137,448 | 1/1979 | Smith | 235/78 G |
| 4,736,093 | 4/1988 | Braly | 235/88 G |
| 4,835,371 | 5/1989 | Rogers | 235/88 R |

*Primary Examiner*—Michael L. Gellner
*Assistant Examiner*—Eddie C. Lee
*Attorney, Agent, or Firm*—Fisher & Associates

[57] ABSTRACT

A golf round timing device is provided for determining the time at which a golfer is to start a golf hole. The golf round timing device comprises a base and a circular disk member. The base has an outer arcuate row of indicia, indicative of time intervals, disposed thereon. The circular disk member has a smaller radius than the outer arcuate row and is rotatably mounted at a mounting point on the base in such a fashion as to be concentric with the outer arcuate row of indicia. The circular disk member has at least one inner arcuate row of indicia indicative of holes on a golf course so that when the inner arcuate row of indicia is aligned with the outer arcuate row of indicia, the time at which the golfer is to start a golf hole may be determined.

14 Claims, 2 Drawing Sheets

GOLF ROUND TIMING DEVICE

BACKGROUND OF THE INVENTION

1. Field of the Invention

The present invention relates generally to registers, and more particularly to a circular calculator for determining the time at which a golfer should have finished a particular hole on a golf course.

2. Description of the Prior Art

The popularity of golf has increased dramatically over the past decade. This increase in popularity has had many positive effects on the sport and several negative effects. One of the negative effects is the overcrowding of public and private golf courses. In an attempt to allow equal access to as many players as possible, many golf course managers have instituted polices which regulate the amount of time that a golfer may spend on a particular hole. The PGA has implemented a four hour schedule for an 18 hole course. In a similar fashion, many public and private courses have adopted this standard or a more lenient four and a half hour standard.

One problem with incorporating such a standard is that the golfer must be aware of where he is on the golf course with respect to time. This requires a mathematical calculation for each hole. As is obvious, this calculation may be accomplished by a calculator or by mental process. The use of a calculator is inappropriate on a golf course since weather conditions may vary. Also, a calculator may be damaged if used during a light drizzle. Turning now to the mental process, an additional burden will be placed upon the golfer each time they need to determine their progress. Additionally, there would be no substantive way to prove to a golf course official that the golfer is on time. Thus, there is a need for a device to compute hole times in an accurate, economical and efficient fashion.

In the past, computation of time intervals has been conducted by circular calculators. For example, U.S. Pat. No. 2,025,625 (Tucker) discloses a device for computing and indicating time intervals of fertility. The device comprises a circular calendar disk which has a peripheral band portion, a calendar portion, and a center portion. The calendar portion is defined by five concentric circles which are further divided by radial lines and thus forming a plurality of arc segments which are 1/62 of the circumference of each concentric circle. Four of the five concentric circles correspond to months having 31, 30, 29 and 28 days, respectively. A plurality of radially extending arms are disposed on the disk. The arms are spaced at predetermined arcuate distances from each other corresponding to 11 day periods on the 31 day circle. By adjusting the first arm to the day of menstruation, a user may determine periods of fertility/infertility by the arcuate segments that are defined between the arms and the five concentric circles. This patent was selected as being indicative of all fertility computing devices utilizing a disk for computation. Other examples of patented fertility timing devices include U.S. Pat. Nos. 2,076,242 (Marquis); 2,098,622 (Gronvold); and 1,942,754 (Heyssler).

Disk computers have been utilized in determining time intervals between work periods. For example, U.S. Pat. No. 1,280,591 (Tuttle) discloses a time computer which is utilized to determine the elapsed time between the beginning and ending of a continuous work period. Further U.S. patents related to work time interval determination include U.S. Pat. No. 1,414,855 (Bishop) and U.S. Pat. No. 3,044,698 (Maluf).

Disk computers have been used in various other applications. For example, U.S. Pat. No. 1,076,680 (Leonard) discloses the determination of transit times on a railway system by the use of a disk computer. Other examples of U.S. patents include U.S. Pat. No. 1,171,753 (Serrell) which discloses the determination of time between arrival and departure from a hotel via a disk computer; U.S. Pat. No. 1,277,723 (Hill) which discloses the determination of time elapsed between two dates; and U.S. Pat. No. 4,835,371 (Rogers) discloses a diving depth computer.

Disk computers have also been used in the golfing field. For example, U.S. Pat. No. 2,485,191 (Culver) discloses a golf score indicator which comprises a first disk having three radial bands; a second disk disposed concentrically with the first disk and having two windows; and a radial arm attached at the center of both disks. The first band represents the number of holes that the golfer is up or down. The second band includes numbers 35 to 55 printed thereon. The third band includes numbers 80 to 100 printed thereon. In operation, the golfer aligns the second disk so that the par for the first 9 and 18 holes are visible through the windows. As the golfer plays, he moves the radial arm to indicate whether he is up or down on strokes.

U.S. Pat. Nos. 2,806,650 (Mead) and 3,627,200 (Sadler) disclose handicap computers which comprises two concentric circles having indicia whose relative alignment is utilized to develop a handicap for a golfer.

U.S. Pat. No. 4,736,093 (Braly) discloses a disk calculator which is used in determining frequently matched sets of golf clubs. On a first disk is indicia which represents flexibility and vibration frequency of a shaft. Disposed concentrically with and above the first disk are a plurality of disks which have indica indicative of club swing weight, club length, hosel length, tip insertion depth, etc. Other examples of U.S. patents include U.S. Pat. Nos. 3,363,836 (Lee) and 3,744,714 (Banner) which disclose circular computers used in determining what golf club to use for a particular distance shot.

U.S. Pat. No. 4,137,448 (Smith) discloses a putting stroke calculator which comprises a plurality of concentric circles having indica thereon.

As may be seen, the use of disk computers or calculators is known in the golfing art but applicant is unaware of any disk computer which is designed to provide an indication of where the golfer should be, with respect to time, on a golf course. Inasmuch as the art is relatively crowded with respect to these various types of disk computers, it can be appreciated that there is a continuing need for an interest in improvements to and new applications for such disk computers, and in this respect, the present invention addresses this need and interest.

SUMMARY OF THE INVENTION

It is therefore an object of the present invention to provide a disk computer which will provide an accurate indication of the expected progress of a golfer along a golf course.

It is a further object to provide an inexpensive means for verifying to a golf course official that a golf player is on schedule.

It is yet another object to provide a disposable timing device.

Finally, it is an object to provide a timing device upon which advertisements or promotional material may be placed. According to one broad aspect of the present invention, there is provided a golf round timing device which comprises a base and a circular disk member. The base has an outer arcuate row of indicia, indicative of time intervals, disposed thereon. The circular disk member has a smaller radius than the outer arcuate row and is rotatably mounted at a mounting point on the base in such a fashion as to be concentric with the outer arcuate row of indicia. The circular disk member has at least one inner arcuate row of indicia indicative of holes on a golf course so that when the inner arcuate row of indicia is aligned with the outer arcuate row of indicia, the time at which the golfer is to start a golf hole may be determined.

Other objects and features of the present invention will be apparent from the following detailed description of the preferred embodiment.

BRIEF DESCRIPTION OF THE DRAWINGS

The invention will be further described in conjunction with the accompanying drawings, in which.

DETAILED DESCRIPTION OF THE PREFERRED EMBODIMENT

Figure 1:
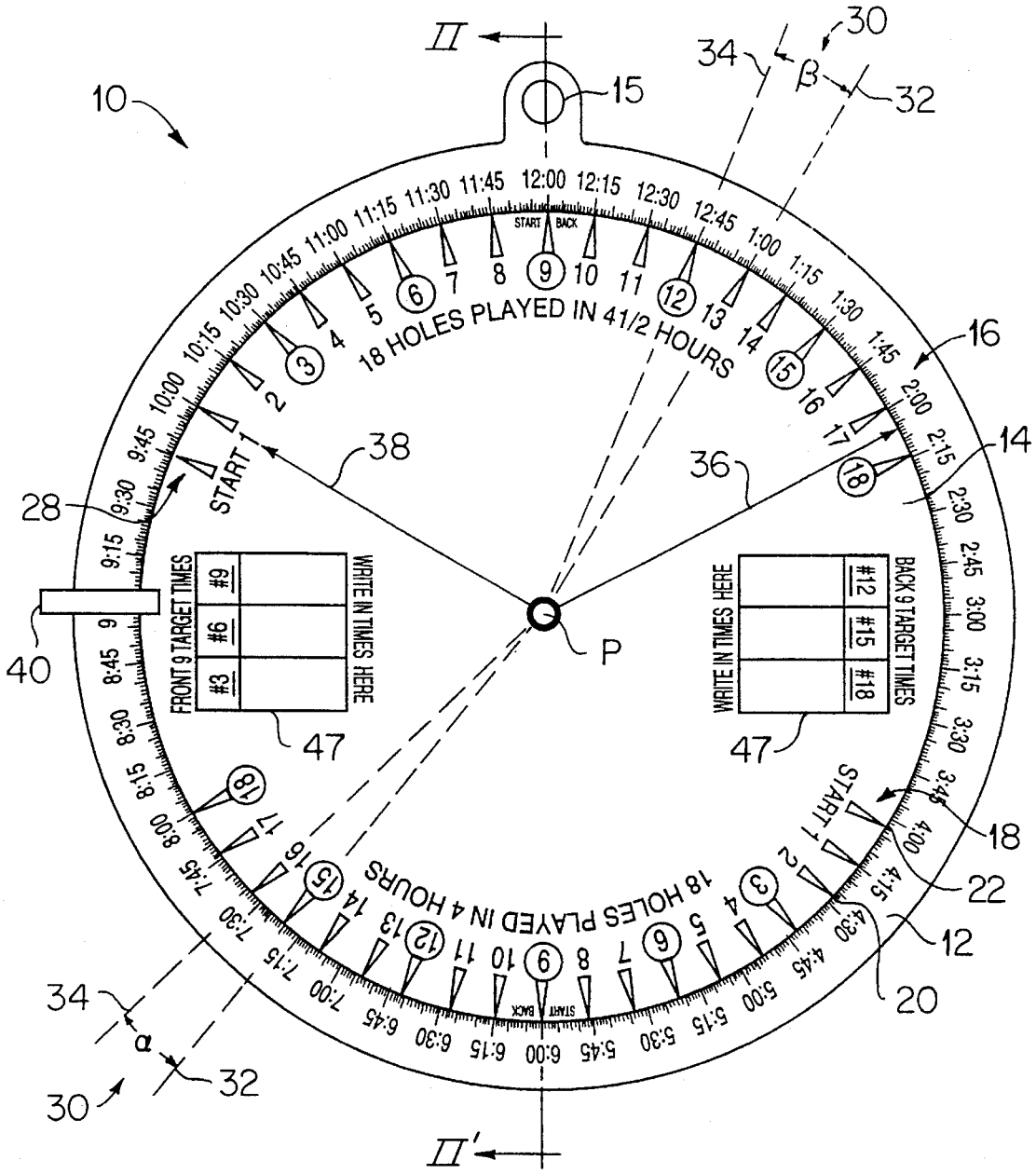
FIG. 1 is a plan view of a golf timing device constructed in accordance with a preferred embodiment of the invention.
Figure 2:
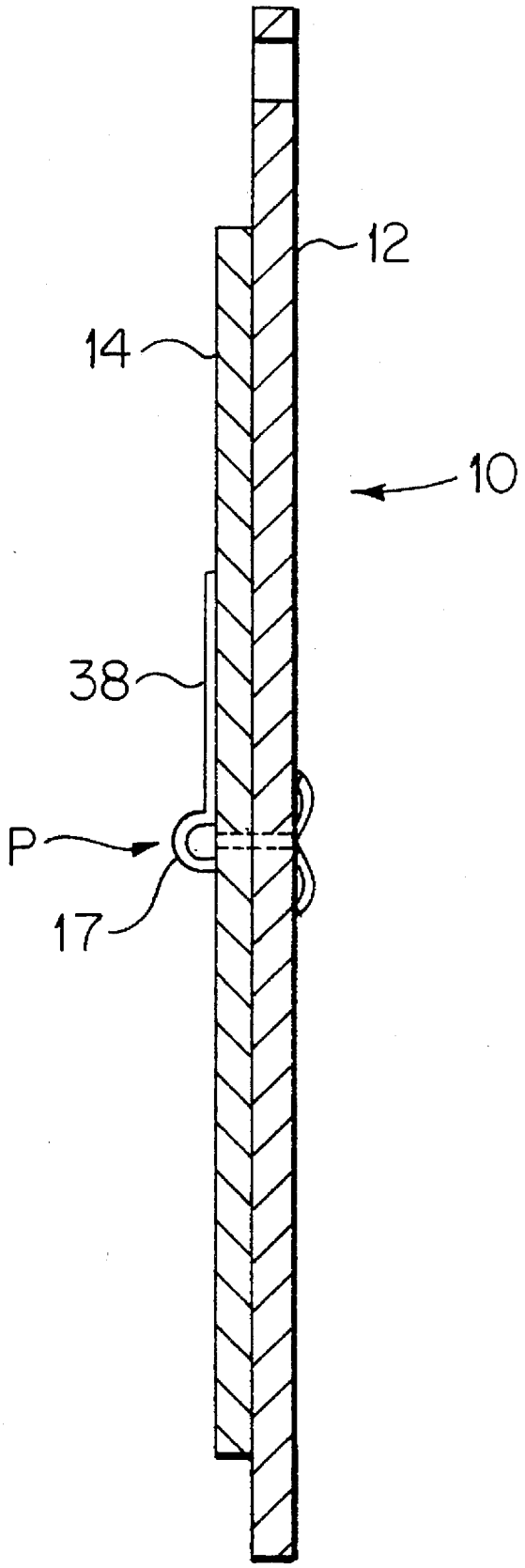
FIG. 2 is a cross sectional view of FIG. 1 taken along line II—II'.

With reference to the figures, wherein like reference characters indicate like elements throughout the several views and, in particular, with reference to FIG. 1, a golf round timing device, generally denoted 10 is illustrated. As may be seen, the timing device 10 comprises a base member 12 and a circular disk member 14. In a preferred embodiment, base member 12 will be circular and have an outer arcuate row of indicia 16 indicative of time intervals disposed along a peripheral edge thereof. The time demarcations are in fifteen minute intervals. There are additional demarcations for one and five minute intervals between each fifteen minute interval. In a preferred embodiment, the outer row of indica will be disposed at a radial distance of approximately 7 cm and the base member will have a radius of approximately 7.75 cm. It should be appreciated that these radial dimensions may be varied to design a larger or smaller timing device 10. Base member 12 may be constructed of any waterproof material used in the printing industry and may also be etched or embossed in metals or plastics. A simple and inexpensive method would be cardboard coated with a plastic laminate to protect it against weather and wear.

Circular disk member 14 has a smaller radius than the outer arcuate row 16 and in a preferred embodiment, will have a radius of about 7 cm. The circular disk member 14 is rotatably mounted at a mounting point P on base member 12 and concentric with the outer arcuate row of indicia 16. Circular disk member 14 is secured to base member 12 by pin or grommet 17. Circular disk member 14 may be constructed of any water proof material use in the printing industry and may be etched or embossed in metals or plastics. A simple and inexpensive method would be cardboard coated with a plastic laminate to protect it against weather and wear. Circular disk member 14 has a first inner arcuate row of indicia 18 which is indicative of holes on a golf course. As may be seen in FIG. 1, there are demarcations for eighteen holes, one of which has been indicated by reference numeral 20, and a start time, indicated by reference numeral 22. There is a second inner arcuate row of indicia 28 which is similar to that of indicia 18. The major difference between the two indicia 18 and 28 is that indicia 18 corresponds to a play time of four hours and indicia 28 corresponds to a play time of four and a half hours.

The distance between two consecutive hole demarcations 20 is defined by an arcuate segment 30. The arcuate segment 30 is defined by the intersection of the arcuate row 18 or 28 and two radial lines 32 and 34 extending from the center of circular disk member 14. These radial lines 32 and 34 define an angle. In the case of arcuate row 18 this angle is marked $\alpha$ and will be 6.72° or 0.11 radians. In the case of arcuate row 28 this angle is marked $\beta$ and will be 7.52°. The radial lines 32 and 34 are set to the outer 720 equally spaced indicia at 13.33 marks or 13.33 minutes per hole and represents a four hour play for eighteen holes of the golf course. The ratio for indicia 28 is set to 15 marks, representing 15 minutes and totaling four and a half hours for eighteen holes of the golf course. It should be appreciated that if the radial dimension of the circular disk member 14 is changed, then the arc length defined by the angles will also change. Thus, it is better to define the distance between two consecutive lines by the arc length which is given by the product of the radius of disk member 14 multiplied by the angle in radians. By using this formula, any size golf round timing device 10 may be created.

Several optional features may be included in the golf round timing device 10. For example, an optional pointer 36 may be affixed at the mounting point P. This pointer 36 is for pointing to the outer arcuate row of indicia 16 and for indicating the number of total game strokes that a golfer takes to finish the golf course. Another option is providing a second pointer 38 affixed to the mounting point P for pointing to the inner arcuate row of indicia 18 or 28. This second pointer 38 is for indicating the current hole being played by the golfer as an assist in scoring. Yet another option includes incorporating a preventing means 40 for preventing the circular disk member 14 from rotating about said mounting point P. This preventing means may be a paper clip or any other preventing means known in the art. Additionally, printed matter such as advertisements may be printed upon the surface disk 14 or member 12. To help in the display of the advertisement, a hole punch or slotted tab 15 is provided on member 12 to facilitate fastening to a golf bag. Lastly, areas 47 are provided for the writing in six times to check progress on the golf course at three hole intervals. These areas may be dull coated, such as a credit card signature area, to enable the use of a writing instrument or may be written on with a grease pencil. Finally, as indicated above, device 10 is utilized to calculate finish times and it should be appreciated that device 10 may also be utilized to calculate start times.

Turning now to the operation of the golf round timing device 10, a golfer would receive device 10 and a tee time. The golfer would then adjust the start indicator 22 to the appropriate tee time. The golfer would use the start indicator 22 on indicia 18 if there was a four hour restriction or would use the one on indicia 28 if there was a four and a half hour restriction. The golfer would use preventing means 40, in a conventional fashion, for securing disk member 14 to member 12. As the golfer plays each hole, he will advance pointers 36 and 38 to keep track of the number of swings and what is the current hole, respectively. If an official stops the golfer to tell him to speed up, the golfer may provide device 10 to the official to verify that the golfer is on time. As mentioned earlier, this device 10 has the advantage of being inexpensive to manufacture, easy to use, accurate, and usable in any type of weather.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A golf timing device for determining the exact time a golfer should finish a golf hole on a golf course, said golf timing device comprising:

a base, said base having an outer arcuate row of indicia indicative of time intervals; and a circular disk member of lesser radius than said outer arcuate row, said circular disk member rotatable mounted at a mounting point on said base and concentric with said outer arcuate row of indicia on said base, said circular disk member having at least one inner arcuate row of indicia indicative of holes on the golf course so that when said inner arcuate row of indicia is aligned with said outer arcuate row of indicia the time at which the golfer is to finish the golf hole may be determined;

wherein said inner arcuate row of indicia has hole marks disposed at 0.11 radian intervals along said inner arcuate row, said intervals corresponding to four hours of play time for eighteen holes of the golf course.

2. The golf timing device recited in claim 1, further comprising a second inner arcuate row of indicia having second hole marks disposed at 0.13 radian intervals along said second inner arcuate row, said intervals corresponding to four and a half hours of play time for eighteen holes of the golf course.

3. The golf timing device recited in claim 1, wherein said outer arcuate row of indicia is delimited in fifteen minute intervals.

4. The golf timing device recited in claim 1, wherein said outer arcuate row of indicia is delimited in five minute intervals.

5. The golf timing device recited in claim 1, wherein said outer arcuate row of indicia is delimited in one minute intervals.

6. The golf timing device recited in claim 1, wherein said outer arcuate row of indicia is indicative of twelve hours.

7. The golf timing device recited in claim 1, wherein said base is circular.

8. The golf timing device recited in claim 1, wherein said base has a diameter of 15.5 cm.

9. The golf timing device recited in claim 1, wherein said circular member has a diameter of 14 cm.

10. The golf timing device recited in claim 1, further comprising at least one pointer affixed at said mounting point for pointing to said outer arcuate row of indicia, said pointer for indicating the number of total game strokes the golfer takes to finish the golf course.

11. The golf timing device recited in claim 1, further comprising at least one pointer affixed to said mounting point for pointing to said inner arcuate row of indicia, said pointer for indicating the current hole being played by the golfer as an assist in scoring.

12. The golf timing device recited in claim 1, further comprising preventing means for preventing said circular disk from rotating about said mounting point.

13. A golf timing device for determining the exact time a golfer should finish a golf hole on a golf course, said golf timing device comprising:

a base, said base having an outer arcuate row of indicia indicative of time intervals;

a circular disk member of lesser radius than said outer arcuate row, said circular disk member rotatably mounted at a mounting point on said base and concentric with said outer arcuate row of indicia on said base, said circular disk member having at least one inner arcuate row of indicia indicative of holes on a golf course, said inner arcuate row of indicia having hole marks disposed at the intersection of said inner arcuate row and radial lines extending from a center of said arcuate row, an arcuate segment between two consecutive radial lines being defined by the product of the radius of said circular disk and the angle between said two consecutive radial lines, said angle being greater than 0.1 radians, said disk rotatable so that when said inner arcuate row of indicia is aligned with said outer arcuate row of indicia the time at which the golfer is to finish the golf hole may be determined; and means for preventing said circular disk from rotating about said mounting point;

wherein said inner arcuate row of indicia has said hole marks disposed at 0.11 radian intervals along said inner arcuate row, said intervals corresponding to four and a half hours of play time for eighteen holes of the golf course.

14. The golf timing device recited in claim 13, further comprising second inner arcuate row of indicia having second hole marks disposed at 0.13 radian intervals along said second inner arcuate row, said intervals corresponding to four and a half hours of play time for eighteen holes of the golf course.

* * * * *